US012352064B2

(12) United States Patent
Zhu et al.

(10) Patent No.: US 12,352,064 B2
(45) Date of Patent: Jul. 8, 2025

(54) ANTI-PONDING FOLDABLE CANOPY TENT

(71) Applicant: Yotrio Group Co., Ltd., Linhai (CN)

(72) Inventors: Faling Zhu, Linhai (CN); Linyong Sun, Linhai (CN); Jianqiang Xie, Linhai (CN)

(73) Assignee: Yotrio Group Co., Ltd., Linhai (CN)

( * ) Notice: Subject to any disclaimer, the term of this patent is extended or adjusted under 35 U.S.C. 154(b) by 216 days.

(21) Appl. No.: 18/220,251

(22) Filed: Jul. 10, 2023

(65) Prior Publication Data

US 2024/0263483 A1 Aug. 8, 2024

(51) Int. Cl.

| | |
|---|---|
| ***E04H 15/28*** | (2006.01) |
| ***E04H 15/48*** | (2006.01) |
| ***E04H 15/50*** | (2006.01) |
| ***E04H 15/52*** | (2006.01) |

(52) U.S. Cl.

CPC ..... *E04H 15/50* (2013.01); *E04H 15/28* (2013.01); *E04H 15/48* (2013.01); *E04H 15/505* (2013.01); *E04H 15/52* (2013.01)

(58) Field of Classification Search

CPC ..... E04H 15/50; E04H 15/28; E04H 15/48; E04H 15/505; E04H 15/52

USPC ..... 135/98, 131, 135, 145, 159

See application file for complete search history.

(56) References Cited

U.S. PATENT DOCUMENTS

| | | | | |
|---|---|---|---|---|
| 2,518,167 | A * | 8/1950 | Mintz | E04H 15/48 135/147 |
| 4,941,500 | A * | 7/1990 | Emard | E04H 15/58 135/141 |
| 5,813,425 | A * | 9/1998 | Carter | E04H 15/50 135/159 |
| 7,314,055 | B2 * | 1/2008 | Guo | E04H 15/28 135/156 |
| 8,590,553 | B2 * | 11/2013 | Lovley, II | E04H 15/50 135/120.2 |
| 11,634,925 | B2 * | 4/2023 | Sun | E04H 15/16 135/145 |
| 2003/0164185 | A1 * | 9/2003 | Price | E04H 15/50 135/131 |
| 2003/0183266 | A1 * | 10/2003 | Suh | E04H 15/50 135/145 |

(Continued)

*Primary Examiner* — Robert Canfield

(74) *Attorney, Agent, or Firm* — Jingming (James) Cai; SAC Attorneys LLP

(57) ABSTRACT

An anti-ponding foldable canopy tent including a tent frame assembly, a ceiling assembly, and a tarpaulin is provided. The ceiling assembly is mounted on the tent frame assembly. The tarpaulin is disposed on the ceiling assembly. The ceiling assembly includes a central lock mechanism and multiple foldable arm mechanisms annularly distributed about a periphery of the central lock mechanism. The ceiling assembly also includes multiple elastic rod mechanisms annularly distributed about the periphery of the central lock mechanism. A first end of each of the elastic rod mechanisms is rotatably connected to the central lock mechanism. A second end of each of the elastic rod mechanisms is connected to the tarpaulin for tensioning the tarpaulin. When the foldable canopy tent is in an extended state, the elastic rod mechanisms support the tarpaulin tightly to preclude ponding on the tarpaulin. The tarpaulin is elastic during tensioning, which precludes ponding.

8 Claims, 5 Drawing Sheets

(56) References Cited

U.S. PATENT DOCUMENTS

| | | | | |
|---|---|---|---|---|
| 2007/0215191 | A1* | 9/2007 | Huang | E04H 15/44 135/131 |
| 2008/0066795 | A1* | 3/2008 | Sy-Facunda | E04H 15/50 135/145 |
| 2010/0275959 | A1* | 11/2010 | Lane | E04H 15/58 24/442 |
| 2011/0073148 | A1* | 3/2011 | Choi | E04H 15/50 135/144 |
| 2015/0247339 | A1* | 9/2015 | Lee | E04H 15/50 135/145 |
| 2015/0308147 | A1* | 10/2015 | Lee | E04H 15/60 135/145 |
| 2020/0157838 | A1* | 5/2020 | Yuan | E04H 15/50 |
| 2023/0295951 | A1* | 9/2023 | Choi | E04H 15/50 135/143 |
| 2024/0318458 | A1* | 9/2024 | Wang | E04H 15/16 |

* cited by examiner

ANTI-PONDING FOLDABLE CANOPY TENT

CROSS-REFERENCE TO RELATED APPLICATIONS

This application claims priority to and the benefit of the patent application titled "An anti-ponding foldable canopy tent", application No. 2023201493759, filed in the China National Intellectual Property Administration on Feb. 8, 2023. The specification of the above-referenced patent application is incorporated herein by reference in its entirety.

FIELD OF THE INVENTION

The present invention, in general, relates to outdoor articles, and in particular, relates to an anti-ponding foldable canopy tent.

BACKGROUND

Currently, foldable canopy tents are one of the widely used outdoor articles for leisure activities. These foldable canopy tents are simple to operate, easy to install, easy to carry, can be opened and closed quickly, and can be used at any time after being opened, with a long service life. A foldable canopy tent usually includes a tent frame assembly, a ceiling assembly, and a tarpaulin, where the tarpaulin is supported by the ceiling assembly. However, the tarpaulin in a conventional foldable canopy tent is nonelastic during tensioning, which causes ponding easily.

SUMMARY OF THE INVENTION

To overcome the above-recited problem in a conventional foldable canopy tent, the present invention provides an anti-ponding foldable canopy tent.

The anti-ponding foldable canopy tent comprises a tent frame assembly, a ceiling assembly, and a tarpaulin. The ceiling assembly is mounted on the tent frame assembly. The ceiling assembly comprises a central lock mechanism and multiple foldable arm mechanisms annularly distributed about a periphery of the central lock mechanism. The tarpaulin is disposed on the ceiling assembly. The ceiling assembly further comprises multiple elastic rod mechanisms annularly distributed about the periphery of the central lock mechanism. A first end of each of the elastic rod mechanisms is rotatably connected to the central lock mechanism, and a second end of each of the elastic rod mechanisms is connected to the tarpaulin for tensioning the tarpaulin.

In an embodiment, each of the elastic rod mechanisms comprises a vertex angle elastic rod and a supporting elastic rod. A first end of the vertex angle elastic rod is rotatably connected to a top fixed disc of the central lock mechanism, and a second end of the vertex angle elastic rod is connected to the tarpaulin for tensioning the tarpaulin. A first end of the supporting elastic rod is rotatably connected to a lower fixed disc of the central lock mechanism, and a second end of the supporting elastic rod is rotatably connected to the vertex angle elastic rod.

In an embodiment, the vertex angle elastic rod is fixed with a support, and the supporting elastic rod is rotatably connected to the support.

In an embodiment, the support comprises a support mounting part and a support hinging part. The support mounting part is fixed to the vertex angle elastic rod during installation. The support hinging part is hinged to the supporting elastic rod.

In an embodiment, the vertex angle elastic rod and/or the supporting elastic rod are made of a glass fiber or a carbon fiber.

In an embodiment, the number of the foldable arm mechanisms is the same as number of the elastic rod mechanisms. The foldable arm mechanisms and the elastic rod mechanisms are arranged in a staggering mode.

In an embodiment, one end of each of the foldable arm mechanisms away from the central lock mechanism, that is, a distal end of each of the foldable arm mechanisms, is connected to a supporting leg of the tent frame assembly.

In an embodiment, the number of the foldable arm mechanisms and the elastic rod mechanisms is both four, and a projection of the tarpaulin on a horizontal plane is rectangular.

In the present invention, the elastic rod mechanisms are folded together with the tent frame assembly. When the foldable canopy tent is in an extended state, the elastic rod mechanisms support the tarpaulin tightly to preclude the tarpaulin from ponding.

Figure 1:
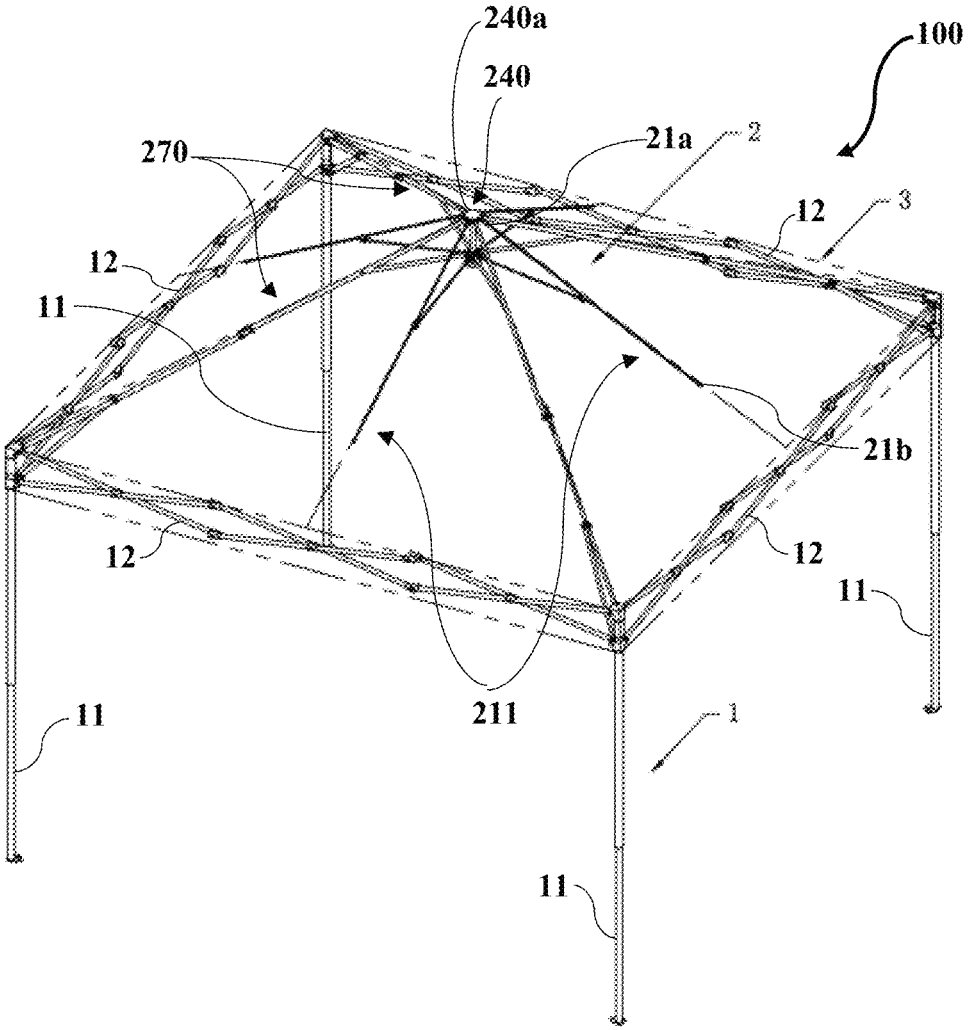
FIG. 1 is a structural diagram of an anti-ponding foldable canopy tent, showing a tarpaulin in dashed lines.

In the figures: 100—anti-ponding foldable canopy tent; 1—tent frame assembly; 11—supporting leg; 12—lateral foldable arm mechanism; 13—sliding sleeve; 2—ceiling assembly; 211—elastic rod mechanisms; 21—vertex angle elastic rod; 22—support; 221—support mounting part; 222—support hinging part; 23—supporting elastic rod; 240—central lock mechanism; 24—top fixed disc; 25—lower fixed disc; 26—center rod; 270—foldable arm mechanisms; 27—vertex angle rod; 28—vertex angle supporting rod; 29—tent frame rod; 210—tent frame supporting rod; and 3—tarpaulin.

DETAILED DESCRIPTION OF THE INVENTION

In the description of the present invention, it is understood that the terms, "one end", "the other end", "horizontal", "central", "end", "length", etc., relating to an orientation or a positional relationship are in line with the orientations or the positional relationships shown in the drawings. Such terms are used herein merely to provide an easy or simplified description of the present invention, rather than indicating or implying that a device or an element must have a specific orientation, or be constructed and operated in a specific orientation, and shall not be understood as a limitation of the present invention.

The present invention is further described with the attached drawings as follows.

Disclosed herein is an anti-ponding foldable canopy tent 100 comprising a tent frame assembly 1, a ceiling assembly 2, and a tarpaulin 3 as shown in FIG. 1 to FIG. 5. The ceiling assembly 2 is mounted on the tent frame assembly 1. The ceiling assembly 2 comprises a central lock mechanism 240, four middle foldable arm mechanisms 270, and four elastic rod mechanisms 211 as shown in FIGS. 1-2 and FIGS. 4-5. The middle foldable arm mechanisms 270 and the elastic rod mechanisms 211 are uniformly and annularly distributed about a periphery 240*a* of the central lock mechanism 240. The tarpaulin 3 is disposed on the ceiling assembly 2. The middle foldable arm mechanisms 270 and the elastic rod mechanisms 211 are arranged in a staggering mode. One end 21*a* of each of the elastic rod mechanisms 211 is rotatably connected to the central lock mechanism 240, and the other end 21*b* of each of the elastic rod mechanisms 211 is connected to the tarpaulin 3 for tensioning the tarpaulin 3.

Figure 3:
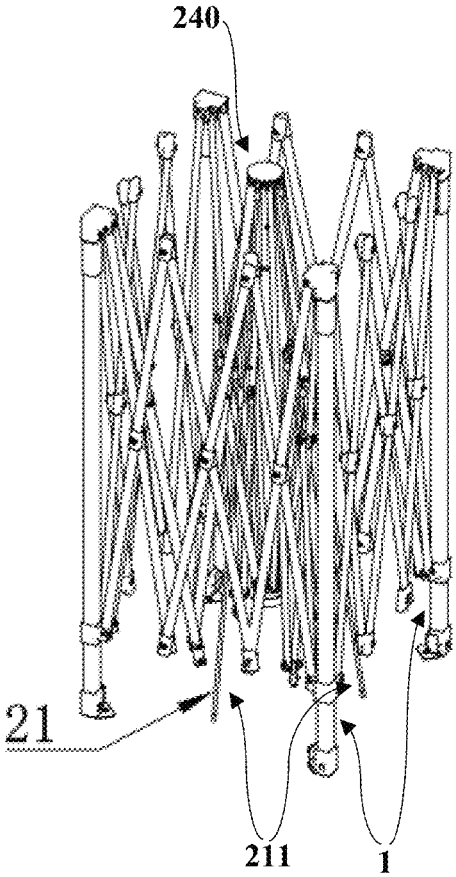
FIG. 3 is a structural diagram of the anti-ponding foldable canopy tent in a folded state without the tarpaulin.

The elastic rod mechanisms 211 of the anti-ponding foldable canopy tent 100 are folded together with the tent frame assembly 1 as shown in FIG. 3. When the anti-ponding foldable canopy tent 100 is in an extended state, the elastic rod mechanisms 211 support the tarpaulin 3 tightly to prevent the tarpaulin 3 from ponding.

Figure 2:
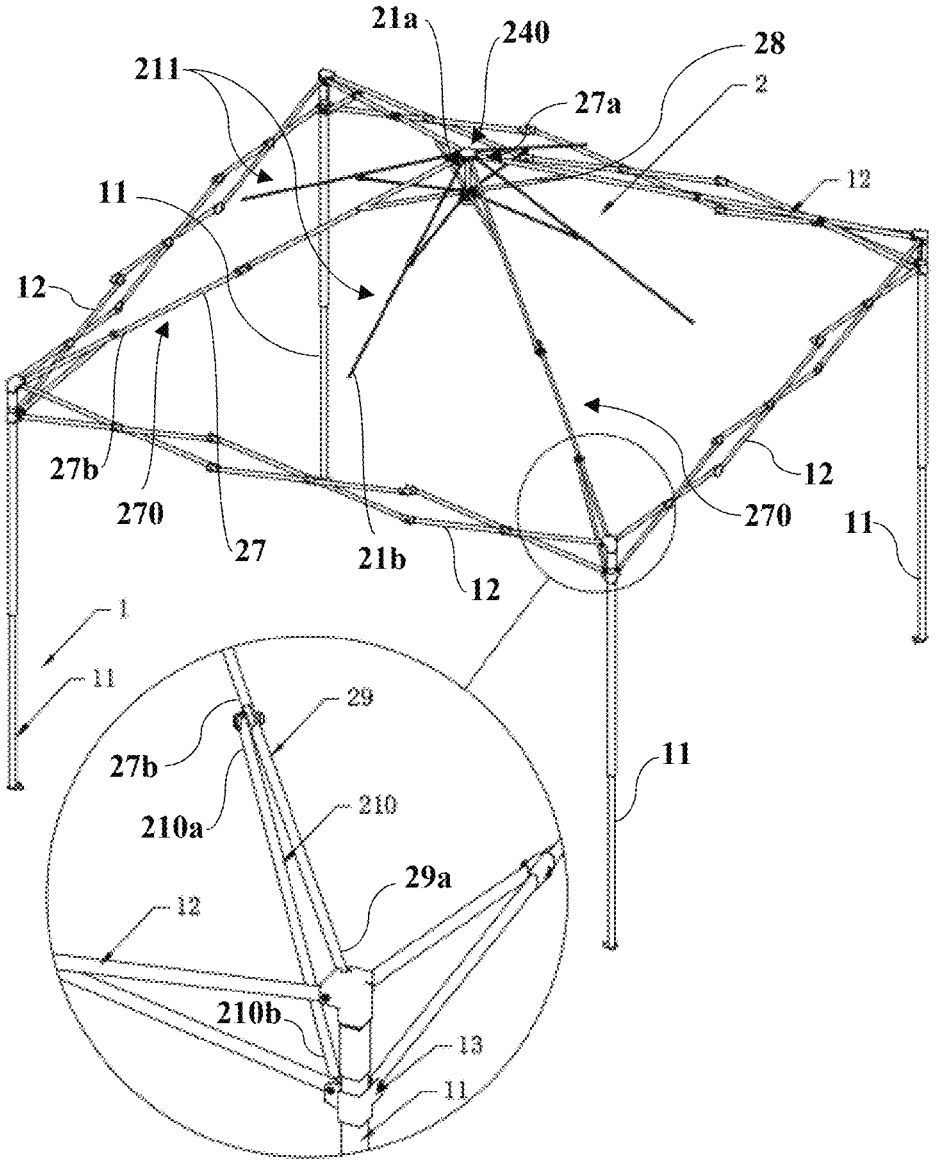
FIG. 2 is a structural diagram of the anti-ponding foldable canopy tent in an extended state without the tarpaulin.
Figure 4:
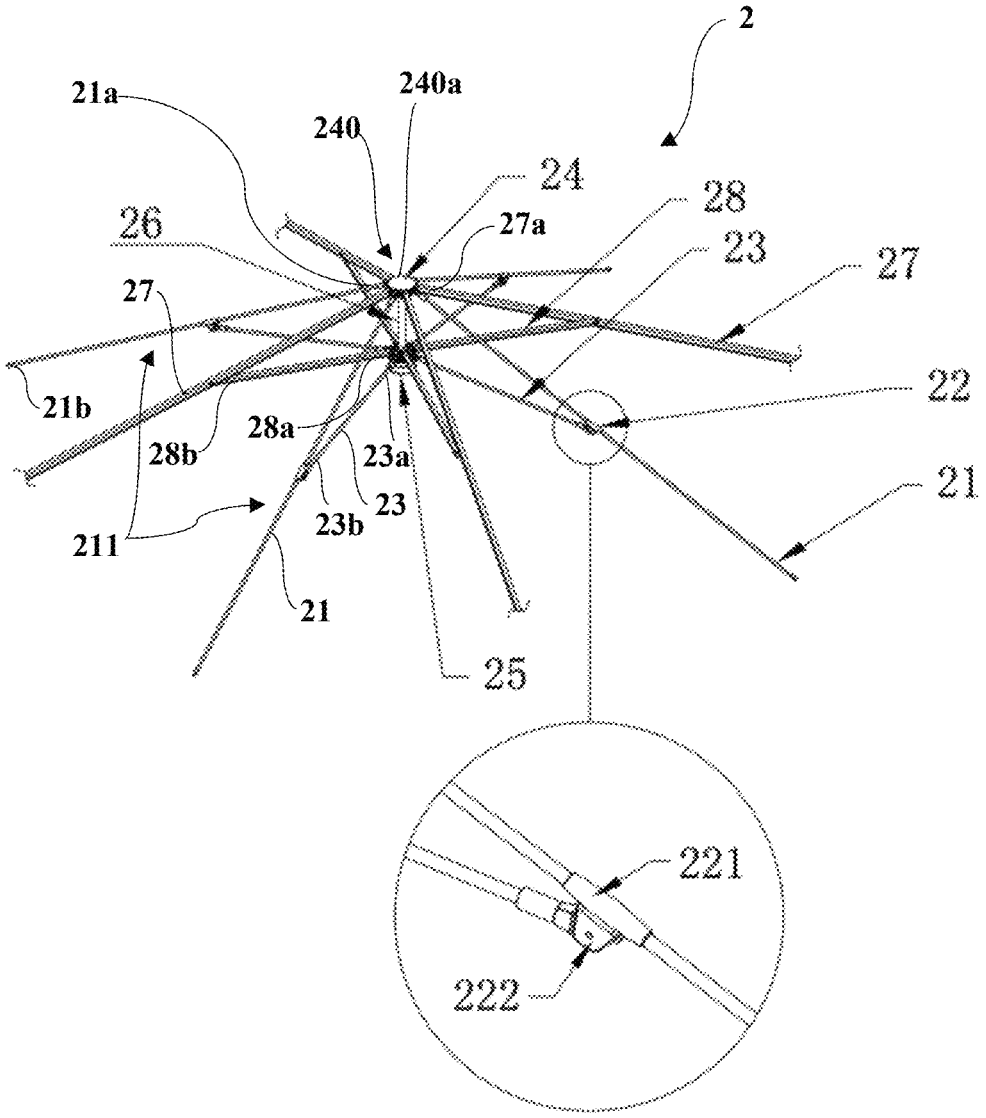
FIG. 4 is a structural diagram of a ceiling assembly of the anti-ponding foldable canopy tent in an extended state.
Figure 5:
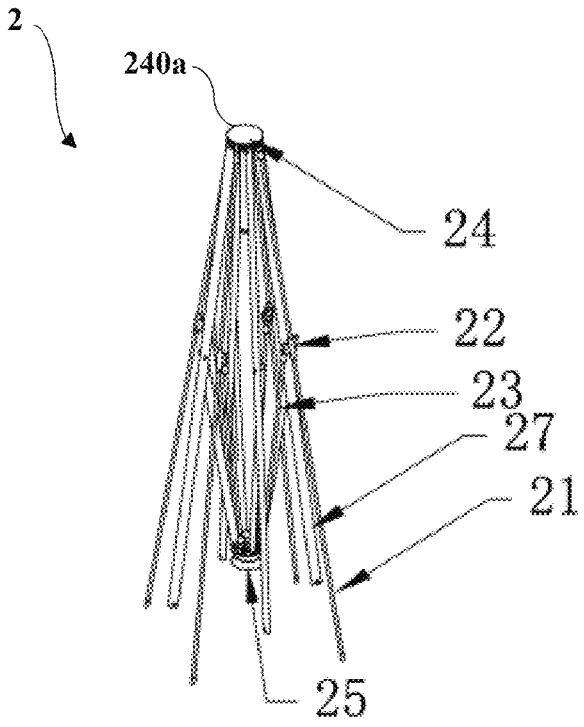
FIG. 5 is a structural diagram of the ceiling assembly of the anti-ponding foldable canopy tent in a folded state.

Referring to FIG. 4, the central lock mechanism 240 comprises a top fixed disc 24, a lower fixed disc 25, and a center rod 26 configured to connect the two discs 24 and 25. Each of the elastic rod mechanisms 211 comprises a vertex angle elastic rod 21 and a supporting elastic rod 23. One end 21*a* of the vertex angle elastic rod 21, shown in FIGS. 1-2 and FIG. 4, is hinged or rotatably connected to the top fixed disc 24 of the central lock mechanism 240. The other end 21*b* of the vertex angle elastic rod 21, shown in FIGS. 1-2 and FIG. 4, is connected to the tarpaulin 3 for tensioning the tarpaulin 3 as shown in FIG. 1. One end 23*a* of the supporting elastic rod 23 is hinged or rotatably connected to the lower fixed disc 25 of the central lock mechanism 240, and the other end 23*b* of the supporting elastic rod 23 is hinged or rotatably connected to the vertex angle elastic rod 21. The vertex angle elastic rod 21 and the supporting elastic rod 23 form an inverted "V"-shaped structure as shown in FIG. 4.

Referring to FIG. 4 again, the vertex angle elastic rod 21 of each of the elastic rod mechanisms 211 is fixed with a support 22. The supporting elastic rod 23 is rotatably connected to the support 22. The support 22 comprises a support mounting part 221 and a support hinging part 222 as shown in an enlarged view of FIG. 4. The support mounting part 221 is fixed and sleeved on the vertex angle elastic rod 21 using fasteners. The support hinging part 222 is hinged to the supporting elastic rod 23.

In an embodiment, the vertex angle elastic rod 21 and the supporting elastic rod 23 are made of a glass fiber. In another embodiment, the vertex angle elastic rod 21 and the supporting elastic rod 23 are made of a carbon fiber or other elastic rod structures.

Referring to FIG. 2 again, the tent frame assembly 1 comprises four supporting legs 11 and four lateral foldable rod mechanisms 12 connected between adjacent supporting legs 11. A sliding sleeve 13 is provided on each supporting leg 11 as shown in FIG. 2, and is configured to slide up and down the supporting leg 11. The four middle foldable arm mechanisms 270 and the four supporting legs 11 are in a one-to-one correspondence with each other. Each of the middle foldable arm mechanisms 270 comprises a vertex angle rod 27, a vertex angle supporting rod 28, a tent frame rod 29, and a tent frame supporting rod 210 as shown in FIG. 2. The vertex angle rod 27 and the vertex angle supporting rod 28 form an inverted "V"-shaped structure. One end 27*a* of the vertex angle rod 27 is hinged to the top fixed disc 24 of the central lock mechanism 240 as shown in FIG. 4, and the other end 27*b* of the vertex angle rod 27 is hinged to the tent frame rod 29 as shown in FIG. 2. One end 28*a* of the vertex angle supporting rod 28 is hinged to the lower fixed disc 25 of the central lock mechanism 240, and the other end 28*b* of the vertex angle supporting rod 28 is hinged to the vertex angle rod 27, as shown in FIG. 4. The tent frame rod 29 and the tent frame supporting rod 210 form an inverted "V"-shaped structure as shown in FIG. 2. A distal end of each of the foldable arm mechanisms 270 is connected to a supporting leg 11 of the tent frame assembly 1. One end 29*a* of the tent frame rod 29 away from the vertex angle rod 27 is hinged to the top of the supporting leg 11. One end 210*a* of the tent frame supporting rod 210 is hinged to the tent frame rod 29, and the other end 210*b* of the tent frame supporting rod 210 is hinged to the sliding sleeve 13 on the supporting leg 11.

Referring to FIG. 1 again, in an embodiment, the projection of the tarpaulin 3 on a horizontal plane is rectangular. In another embodiment, the projection of the tarpaulin 3 on a horizontal plane is a square.

In an embodiment as shown in FIGS. 1-2, the number of the foldable arm mechanisms 270 is same as number of the elastic rod mechanisms 211. It should be understood that, the number and the distribution of the supporting legs 11 of the anti-ponding foldable canopy tent 100 can be adjusted as required; accordingly, the number and the distribution of the lateral foldable arm mechanisms 12, the middle foldable arm mechanisms 270, and the elastic rod mechanisms 211, and the shape of the tarpaulin 3 can be adjusted as required.

It shall be noted that the above embodiments have been provided only for illustrating the technical scheme of the present invention and not to limit the present invention. Although the present invention has been detailed with reference to the above embodiments, those ordinarily skilled in the art should understand that they can still modify the technical scheme recorded in the foregoing embodiments, or perform equivalent replacements on some or all of the technical features; however, such modifications or replacements do not separate the essence of technical schemes from the substance and scope of the technical scheme provided by the embodiments of the present invention.

We claim:

1. An anti-ponding foldable canopy tent comprising:

a tent frame assembly;

a ceiling assembly mounted on the tent frame assembly, wherein the ceiling assembly comprises a central lock mechanism and a plurality of foldable arm mechanisms annularly distributed about a periphery of the central lock mechanism; and a tarpaulin disposed on the ceiling assembly, wherein the ceiling assembly further comprises a plurality of elastic rod mechanisms annularly distributed about the periphery of the central lock mechanism, wherein a first end of each of the elastic rod mechanisms is rotatably connected to the central lock mechanism, and a second end of the each of the elastic rod mechanisms is connected to the tarpaulin for tensioning the tarpaulin, wherein each of the elastic rod mechanisms comprises a vertex angle elastic rod and a supporting elastic rod, wherein a first end of the vertex angle elastic rod is rotatably connected to a top fixed disc of the central lock mechanism, and a second end of the vertex angle elastic rod is connected to the tarpaulin for tensioning the tarpaulin, and wherein a first end of the supporting elastic rod is rotatably connected to a lower fixed disc of the central lock mechanism, and a second end of the supporting elastic rod is rotatably connected to the vertex angle elastic rod.

2. The anti-ponding foldable canopy tent according to claim 1, wherein the vertex angle elastic rod is fixed with a support, and wherein the supporting elastic rod is rotatably connected to the support.

3. The anti-ponding foldable canopy tent according to claim 2, wherein the support comprises a support mounting part and a support hinging part, wherein the support mounting part is fixed to the vertex angle elastic rod, and wherein the support hinging part is hinged to the supporting elastic rod.

4. The anti-ponding foldable canopy tent according to claim 1, wherein one or more of the vertex angle elastic rod and the supporting elastic rod are made of one of a glass fiber and a carbon fiber.

5. The anti-ponding foldable canopy tent according to claim 1, wherein a distal end of each of the foldable arm mechanisms is connected to a supporting leg of the tent frame assembly.

6. The anti-ponding foldable canopy tent according to claim 1, wherein number of the foldable arm mechanisms is same as number of the elastic rod mechanisms, and wherein the foldable arm mechanisms and the elastic rod mechanisms are arranged in a staggering mode.

7. The anti-ponding foldable canopy tent according to claim 6, wherein the number of the foldable arm mechanisms and the elastic rod mechanisms is four.

8. The anti-ponding foldable canopy tent according to claim 1, wherein a projection of the tarpaulin on a horizontal plane is rectangular.

* * * * *